United States Patent [19]

Motomura et al.

[11] Patent Number: 5,042,399

[45] Date of Patent: Aug. 27, 1991

[54] HEARTH ARRANGEMENT FOR MELTING FURNACE

[75] Inventors: Takehiko Motomura, Funabashi; Hitoshi Hagihara, Tokyo; Satoshi Inoue, Asaka, all of Japan

[73] Assignee: Ishikawajima-Harima Heavy Industries Co., Ltd., Tokyo, Japan

[21] Appl. No.: 610,201

[22] Filed: Nov. 7, 1990

[30] Foreign Application Priority Data

Nov. 10, 1989 [JP] · Japan ..... 1-31487[U]

[51] Int. Cl.[5] ..... F23J 1/00

[52] U.S. Cl. ..... 110/165 R; 110/171; 110/259

[58] Field of Search ..... 110/165 R, 168, 171, 110/259

[56] References Cited

U.S. PATENT DOCUMENTS

| | | | |
|---|---|---|---|
| 3,741,136 | 6/1973 | Stookey | 110/171 X |
| 4,109.590 | 8/1978 | Mansfield | 110/165 R X |
| 4,210,087 | 7/1980 | Melan et al. | 110/165 R X |

FOREIGN PATENT DOCUMENTS

| | | | |
|---|---|---|---|
| 0201185 | 7/1983 | Fed. Rep. of Germany | 110/165 R |

*Primary Examiner*—Edward G. Favors
*Attorney, Agent, or Firm*—Harness, Dickey & Pierce

[57] ABSTRACT

A hearth arrangement for a furnace which melts refuses carried on the hearth arrangement comprises a plurality of hearth blocks arranged like a stair. The heart blocks are inclined stepwise in a refuse carrying direction and each hearth block has a width direction perpendicular to the refuse carrying direction. Each hearth block is divided into two block elements in the width direction of the hearth block and the two block elements are joined to each other by springs which exerts a biasing force on the block elements in the width direction of the hearth block. A clearance is formed between each two adjacent hearth blocks to tolerate heat expansion of the hearth blocks. Each block has a protuberance extending over a next hearth block located in the ash carrying direction such that the ash does not flow into the clearance between the hearth blocks. A convex portion is formed on a contacting plane of one block element and a concave portion is formed in a contacting plane of the other block element such that the convex portion engages with the concave portion to ensure a tight engagement of two block elements.

20 Claims, 4 Drawing Sheets

HEARTH ARRANGEMENT FOR MELTING FURNACE

BACKGROUND OF THE INVENTION

1. Technical Field

The present invention relates to a hearth arrangement for a melting furnace which melts incineration residue with heat generated upon combustion of unburnt carbon contained in the incineration residue.

2. Background Art

Various melting furnaces have been proposed and one of the typical examples is disclosed in Japanese Utility Model Registration Application No. 62-152218 filed Oct. 6, 1987. FIG. 5 of the accompanying drawings illustrates a perspective view of the melting furnace of the above-mentioned Japanese Application. (This application was laid open Apr. 19, 1989.)

As shown in FIG. 5, a hearth (a) of the conventional melting furnace is constructed by arranging a plurality of V-shaped hearth blocks (b) made from refractory material such as ceramics in the form of stairs. Electric heaters (e) are embedded in the hearth block (b) to heat the incineration residue delivered from an after-burning stoker (c), and air supply pipes (f) are provided on the surface of the hearth block (b). These air supply pipes (f) are located between each two adjacent hearth blocks (b) with nozzle holes (g) thereof being exposed to atmosphere. Air is discharged from the nozzle holes (g) as the combustion air to combust the incineration residue (d) carried thereon. Consequently, this hearth arrangement melts and discharges the incineration ash by combusting carbon contained in the incineration residue (d) while allowing the incineration residue (d) dumped on the upstream side of the hearth (a) to move toward the downstream side on the hearth top surface formed on a valley-like hearth blocks by means of a pusher 7.

However, the combustion temperature of the incineration residue becomes as high as 1300°-1400° C. This produces cracks at the bending portion of the hearth block (b) (the bottom of the letter "V") due to rapid thermal expansion, which eventually results in breakage of the hearth (a).

The hearth top surface is shaped like a letter "V" to collect the incineration residue toward the center, i.e., to prevent the lateral overflow of the residue. However, the conventional hearth arrangement is not sufficient to thoroughly prevent the overflow. This reduces the transferrable volume and results in poor melting efficiency.

In addition, these is another problem that the air supply pipes (f) are bent and twisted toward the downstream side as the incineration residue is transferred on the air pipes (f) to the downstream side of the hearth by the pusher (h). This changes the air injection angle of the nozzle holes (g) of the air supply pipes (f) and therefore a desired treatment of the residue cannot be expected.

SUMMARY OF THE INVENTION

An object of the present invention is to prevent the cracking of the V-shaped hearth block.

Another object of the present invention is to prevent the overflow of the incineration residue from the hearth arrangement.

Still another object of the present invention is to prevent the bending and twisting of the air supply pipes exposed to the moving incineration residue.

A hearth arrangement for a furnace which melts refuses carried on the hearth arrangement according to one aspect of the present invention is characterized in that the arrangement comprises a plurality of hearth blocks arranged like a stair, that the hearth blocks are inclined stepwise in the ash carrying direction, that each hearth block has a width direction perpendicular to the ash carrying direction, that each hearth block is divided into two block elements in the width direction of the hearth block and that the two block elements are joined to each other by springs which exerts a biasing force on the block elements in the width direction of the hearth block. A clearance is preferably formed between each two adjacent hearth blocks to tolerate heat expansion of the hearth blocks. Each block may have a protuberance extending over a next hearth block located in the ash carrying direction such that the ash do not flow into the clearance between the hearth blocks. A convex portion is preferably formed on a contacting plane of one block element and a concave portion is formed in a contacting plane of the other block element such that the convex portion engages with the concave portion to ensure a tight engagement of two block elements.

DESCRIPTION OF THE PREFERRED EMBODIMENTS

An embodiment of the present invention will be described in detail with reference to the drawings.

Figure 4:
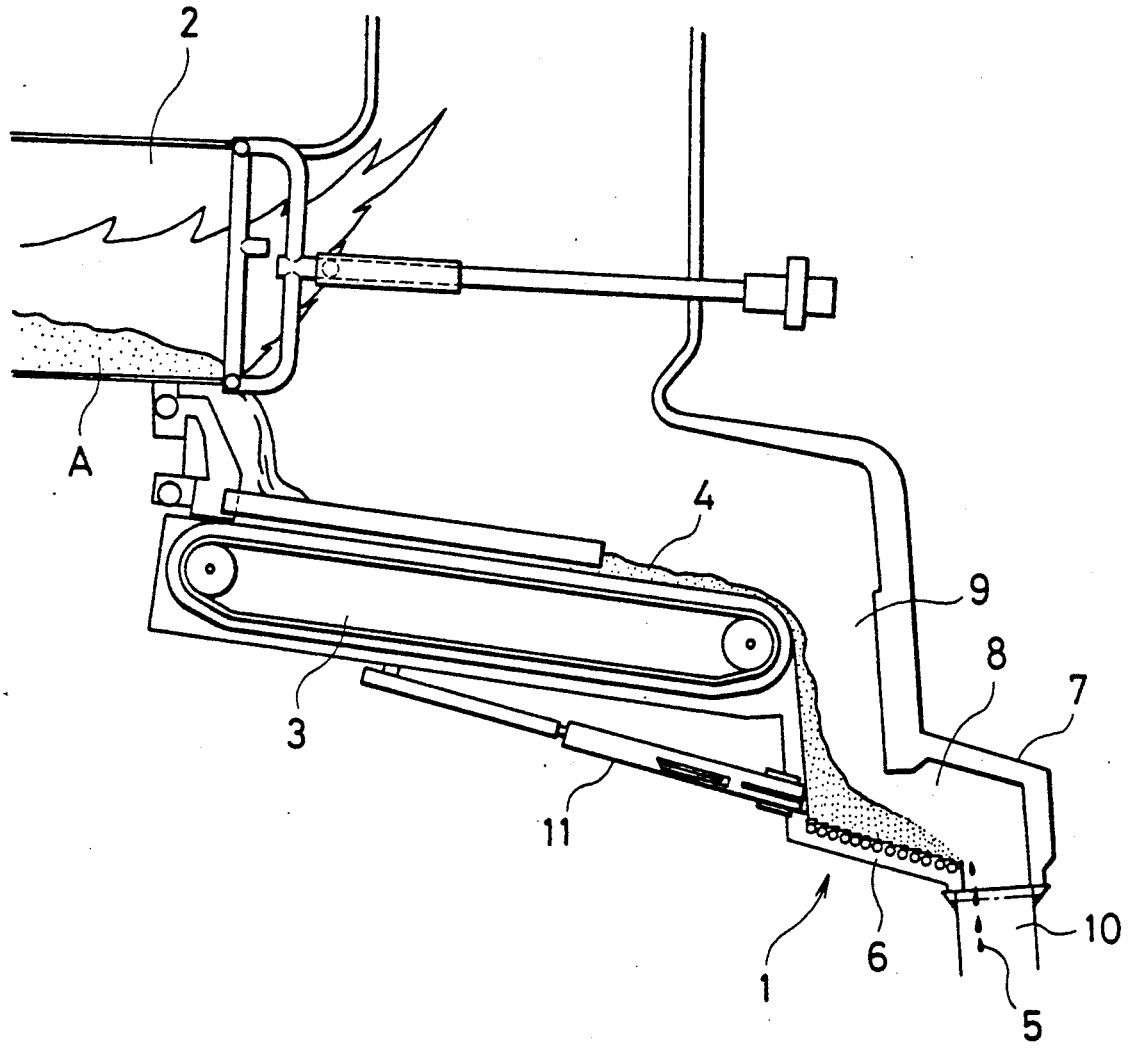
FIG. 4 illustrates a general flow of the incineration residue.
Figure 5:
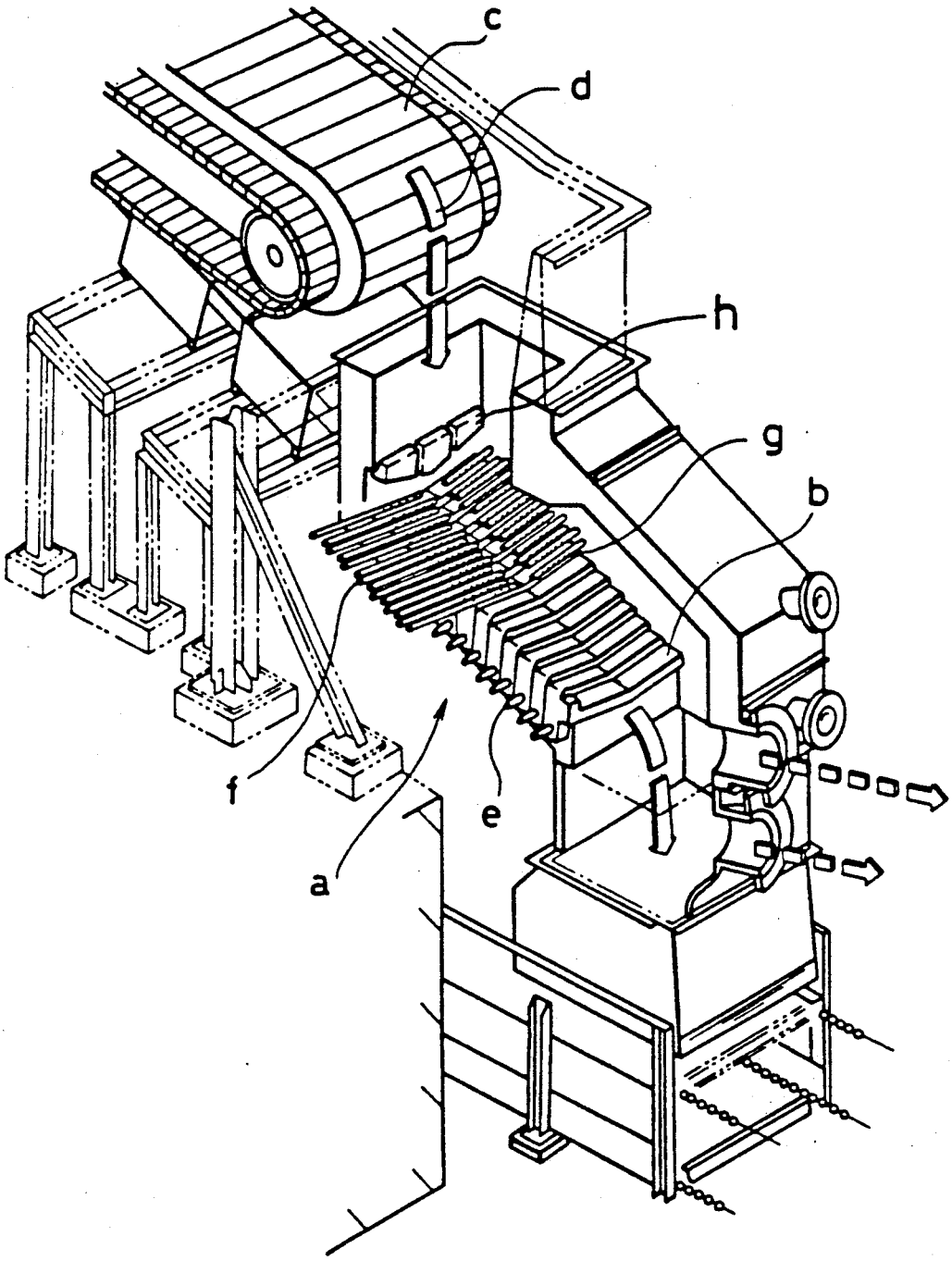
FIG. 5 PRIOR ART
FIG. 5 illustrates a conventional melting furance.

As shown in FIG. 4, a melting furnace 1 is disposed downstream of an after-burning stoker 3. A rotary kiln type main combustion furnace 2 is disposed upstream of the after-burning stoker 3. The main combustion furnace 2 incinerates solid wastes A such as municipal refuses or industrial wastes and dicharges them as the incineration residue 4 onto the after-burning stoker 3. The after-burning stoker 3 further combusts the incineration residue 4 and transfers it onto the ash melting furnace 1 installed downstream thereof. Then, the ash melting furnace 1 combusts the incineration residue 4 containing unburnt carbon and recovers the incineration residue 4 in the form of liquid molten slag 5.

A hearth 6 is provided in the ash melting furnace 1. A combustion chamber of the ash melting furnace 1 is defined by a furance casing 7. The furnace casing 7 is made from a refractory material. The furnace casing 7 also defines a passage 8 tilted downward from the hearth 6. Numeral 9 designates a hopper provided as an inlet to guide the incineration residue 4 discharged from the after-burning stoker 3 onto the hearth 6. A molten slag discharge passage 10 is connected to the downstream end of the furnace casing 7, and the molten slag 5 is led to a slag-transfering, water-sealed conveyor (not shown) by the passage 10. At the upstream end of the hearth 6, there is provided a pusher 11 controlled by CPU (not shown) to carry the incineration residue 4 on the hearth 6 toward the downstream end of the hearth 6.

Figure 1:
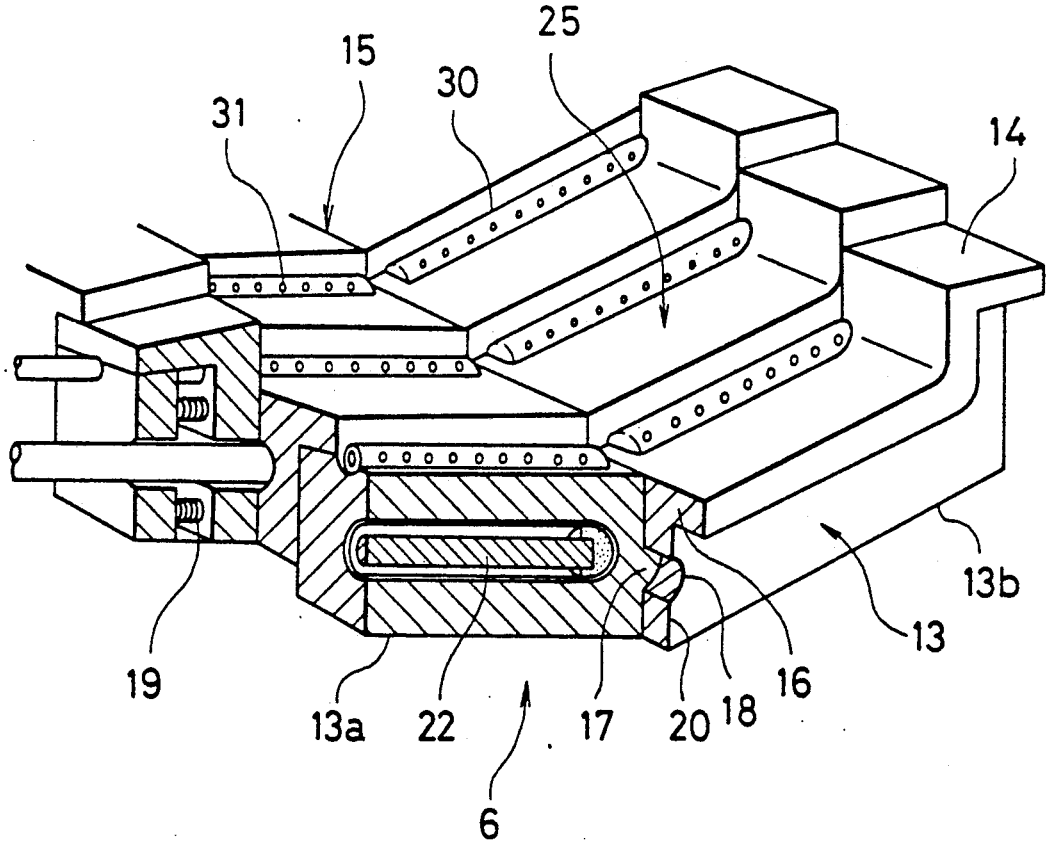
FIG. 1 is a partial perspective view showing an internal structure of a hearth arrangement according to one embodiment of the present invention.
Figure 2:
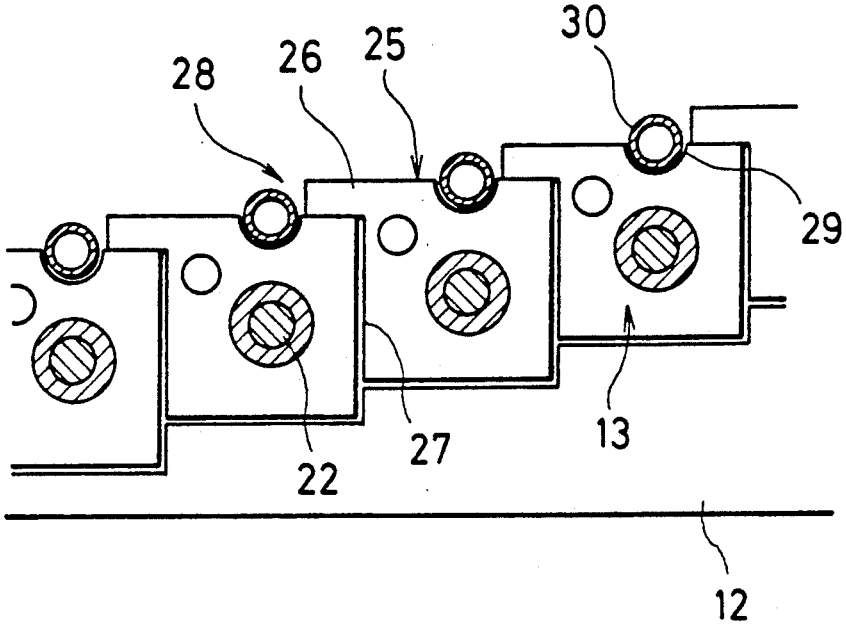
FIG. 2 is a partial sectional view of the embodiment according to the present invention.
Figure 3:
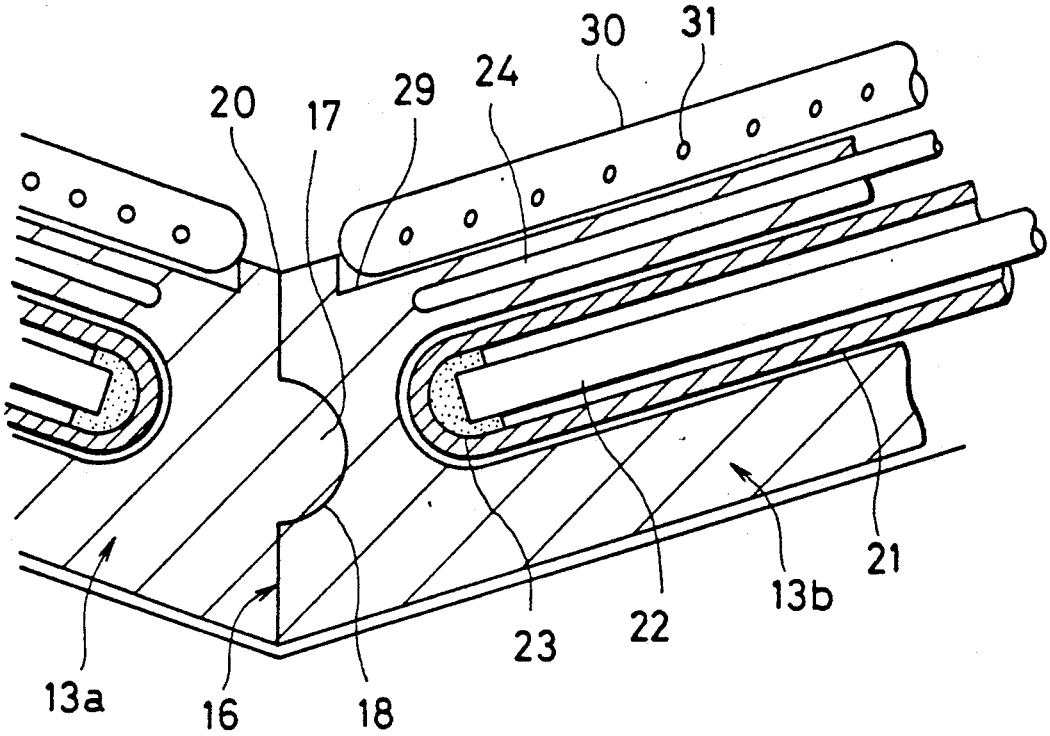
FIG. 3 is a partial sectional view of the hearth arrangement according to the presen invention.

Referring to FIGS. 1 and 2, the hearth 6 is constructed by assembling on the heat-resistant base 12 the hearth blocks 13 in a multiple-stair form. The hearth block 13 has a V-letter shape and is made from a material of excellent heat and wear resistance such as silicon carbide ceramics. At both ends of the V-letter-shaped hearth block 13, there are raised overflow prevention collars 14 to prevent the incineration residue 4 and molten slag 5 produced upon melting of the incineration residue 4 from overflowing the lateral ends of the hearth 6. Each hearth block 13 is divided into two block elements, namely blocks 13*a* and 13*b*, at the center or the bending portion 15 of the letter V. A convex portion 17 is formed on the contact surface 16 of one block element 13*a* (left half in the illustration) whereas a concave portion 18 is formed in the contact surface 16 of the other block element 13*b* (right half in the illustration) to engage with the convex portion 17. The divided block elements 13*a* and 13*b* are joined with each other at the respective contact surfaces 16 by means of biasing springs 19 with an elastic heat-resistant seal 20 being interposed between the two block elements 13*a* and 13*b*. As shown in FIGS. 3 and 1, rod-shaped electric hearth heaters 22 are installed inside the block elements 13*a* and 13*b*. The heater 22 extends in a heater protector 21 made from a heat-insulating material. The heater protector 21 extends in the width direction of the block (left and right direction in FIG. 3). The electric hearth heaters 22 heat and melt the incineration residue 4. The heating prevents adhesion of the molten slag 5 on the hearth block 13, i.e., the heating prevents cooling and solidifying of the slag 5. The hearth heater 22 is supported by heater receiving caps 23 provided at both longitudinal ends of the interior of the heater protector 23. The cap 23 is made from an insulating material having a resistance of at least 0.1 MΩ−cm to prevent breakage of the hearth block 13 due to heat reflection of the hearth heater 22. In addition, a thermocouple 24 is installed inside the hearth block 13. The thermocouple 24 extends in the direction parallel to the hearth heating electiric heater 22 to measure temperature of the hearth block 13.

A predetermined clearance 27 is formed between each two adjacent hearth blocks 13 to accommodate the thermal expansion of the hearth block 13 due to combustion heat, as shown in FIG. 2. The top surface 25 of the hearth block 13 extends horizontally in the downstream direction (left in FIG. 2) over the top surface 25 of the next downstream side hearth block 13, thereby defining a protuberance 26. The protuberances 26 prevent the incineration residue 4 and molten slag 5 from flowing into the clearance 27 between hearth blocks 13.

As shown in FIGS. 2 and 3, a groove 29 is formed in the stair-form hearth top surface 25 of the hearth block 13 and in the vicinity of the joint portion 28 of each two hearth blocks 13. The groove 29 extends in the direction parallel to the protuberance 26 or extends in the width direction of the hearth 6. The air supply pipe 30 is partially received in the groove 29 in the diametrical direction of the pipe 30 and entirely received in the groove 29 in the longitudinal direction of the same. The air supply pipes 30 supply combustion air to the incineration residue 4 which flows on the hearth top surface 25 and has a number of the air nozzles 31 provided at predetermined intervals in the longitudinal direction of the pipe 30. The combustion air is injected from the nozzles 31 in an upward downstream direction, namely 20 to 50 degrees upward relative to the horizontal direction. The combustion air spouted from the air injection nozzles 31 is preheated by a heat exchanger (not shown) to improve the combustion efficiency.

Next, the operation of the embodiment will be described.

Referring to FIG. 4, municipal refuse or industrial wastes A supplied to the main combustion furnace 2 are combusted with the combustion air, then, transferred onto the after-burning grate stoker 3 in the form of incieration residue 4 for further combustion. In this case, in order to increase the melting efficiency of the incineration residue 4, the electric heater 21 (FIG. 3) disposed in the hearth blocks 13 are energized to heat the hearth 6 to a specified temperature. The incineration residue 4 fired in the after-burning stoker 3 is then introduced into the ash melting furnace 1 through the hopper 9 connected to the after-burning stoker 3. In this event, a certain volume of unburnt carbon is left in the incineration residue. The unburnt carbon content of the incineration residue 4 at the main combustion furnace 2 is preferably adjusted to 6 wt % or more. Specifically, the residual carbon content is controlled through the detection of combustion information such as an amount of the refuses to be burned, a gas temperature in the combustion furnaces, a combustion air volume in the combustion furnaces, a feed rate of the refuses and a rotating speed of the furnaces by use of a TV camera (not shown).

The incineration residue 4 containing unburnt carbon drops from the hopper section 9 to the upstream side of the hearth arrangement 6 of the ash melting furnace 1 and is carried to the downstream side by the CPU-controlled pusher 11. During this movement, the incineration residue 4 does not laterally overflow from the hearth arrangement 6 since the overflow prevention collars 14 are formed along the both lateral edges of the hearth blocks. Also, since the air supply pipes 29 are securely received in the recess 29 formed in the top surface 25 of the hearth blocks 13, the air supply pipes 29 are not bent by the incineration residue 4 moved by the pushers 11. In addition, because the clearance 27 between the hearth blocks 13 is sealed by the protuberances 26, the incineration residue 4 and molten slag 5 will not clog up the clearance 27 or leak through the clearance 27.

The incineration residue 4 on the hearth top surface 25 is further combusted with high-temperature combustion air spouted from the air nozzles 30 and melted with the combustion heat to become the molten slag 5. The hearth blocks undergo the thermal expansion due to this combustion, but the thermal expansion in the molten slag flowing direction is tolerated by the clearance 27 provided between hearth blocks and the thermal expansion in the widthwise direction is tolerated with the spring-biased movable block elements 13*a* and 13*b*. Consequently, breakage of the hearth block 13 due to volumetric change such as thermal expansion or thermal shrinkage can be prevented.

The molten slag 5 generated by melting the incineration residue 4 is collected toward the center 15 of the V-shaped hearth top surface 25 and flows toward the downstream end of the hearth arrangement 6 like a stream. After that, the slag 5 flows onto the slag-carrying, water-sealed conveyor (not shown) through the discharge passage 10, and it is cooled and solidified for recovery.

Because the contact surfaces 16 have the convexo-concave portion 17 and 18 and the heat-resistant seal 26 is provided between the contact faces 16, there is no chance for the liquid molten slag 5 to leak through the hearth block elements 13*a* and 13*b*.

At the final point of the incineration, the solid waste A is recovered in the form of molten slag having a volume of about 2% of that before incineration.

We claim:

1. A hearth arrangement for a furnace which melts ash carried on the hearth arrangement, characterized in that the hearth arrangement comprises a plurality of hearth blocks arranged like a stair, that the hearth blocks are inclined stepwise in a refuse carrying direction, that each hearth block has a width direction perpendicular to the ash carrying direction, that each hearth block is divided into two block elements in the width direction of the hearth block and that the two block elements are joined to each other by a force exterted on the block elements and acting in the width direction of the hearth block.

2. The hearth arrangement of claim 1, characterized in that the furnace block is made from ceramics such as silicon carbide.

3. The hearth arrangement of claim 1, characterized in that a clearance is formed between each two adjacent hearth blocks to tolerate heat expansion of the hearth blocks.

4. The hearth arrangement of claim 1, characterized in that each hearth block has a protuberance extending over a next hearth block located in the ash carrying direction such that the ash does not flow between the hearth blocks.

5. The hearth arrangement of claim 1, characterized in that collars are formed along edges of the hearth blocks such that the ash carried on the hearth blocks does not overflow.

6. The hearth arrangement of claim 1, characterized in that a convex portion is formed on a contacting plane of one block element and a concave portion is formed in a contacting plane of the other block element such that the convex portion engages with the concave portion to ensure a tight engagement of two block elements.

7. The hearth arrangement of claim 1, characterized in that a heat resistant seal is provided between the two block elements.

8. The hearth arrangement of claim 1, characterized in that the arrangement further includes an air injection pipe for supplying air used to melt the ash and that each block element has a groove to receive the air injection pipe.

9. The hearth arrangement of claim 8, characterized in that the air injection pipe extends in the width direction of the hearth block, that the air injection pipe possesses a plurality of nozzles provided in the width direction of the hearth block, that the air injection pipe spouts air diagonally upward in the ash carrying direction at an angle of between 20 and 50 degrees relative to a horizontal direction.

10. The hearth arrangement of claim 1, characterized in that a heater is provided in the hearth block for maintaining a surface of the hearth block to a predetermined temperature.

11. The hearth arrangement of claim 10, characterized in that the heater contacts the hearth block via a cap member made from an insulating material and having a resistance of at least 0.1 MΩ−cm.

12. The hearth arrangement of claim 1, characterized in that a thermocouple is provided in the hearth block for measuring a temperature of the hearth block.

13. The hearth arrangement of claim 1, characterized in that the arrangement further includes springs for exerting a force on the block elements in the width direction of the hearth block to ensure a tight engagement of the block elements.

14. The hearth arrangement of claim 3, characterized in that each hearth block has a protuberance extending over a next hearth block located in the refuse carrying direction such that the ash does not flow between the hearth blocks.

15. The hearth arrangement of claim 3, characterized in that collars are formed along edges of the hearth blocks such that the ash carried on the hearth blocks does not overflow.

16. The hearth arrangement of claim 15, characterized in that collars are formed along edges of the hearth blocks such that the ash carried on the hearth blocks does not overflow.

17. The hearth arrangement of claim 3, characterized in that a convex portion is formed on a contacting plane of one block element and a concave portion is formed in a contacting plane of the other block element such that the convex portion engages with the concave portion to ensure a tight engagement of two block elements.

18. The hearth arrangement of claim 3, characterized in that a heat resistant seal is provided between the two block elements.

19. The hearth arrangement of claim 3, characterized in that the arrangement further includes air injection pipe for supplying air used in melting the ash and that each block element has a groove to receive one air injection pipe.

20. The hearth arrangement of claim 3, characterized in that a heater is provided in the hearth block for maintaining a surface of the hearth block to a predetermined temperature.

* * * * *